US010012364B2

(12) United States Patent
Lanez

(10) Patent No.: US 10,012,364 B2
(45) Date of Patent: Jul. 3, 2018

(54) LIGHT DIFFUSER CASING

(71) Applicant: ZEDEL, Crolles (FR)

(72) Inventor: Raphaël Lanez, Crolles (FR)

(73) Assignee: ZEDEL, Crolles (FR)

( * ) Notice: Subject to any disclaimer, the term of this patent is extended or adjusted under 35 U.S.C. 154(b) by 0 days.

(21) Appl. No.: 15/628,007

(22) Filed: Jun. 20, 2017

(65) Prior Publication Data

US 2017/0370545 A1 Dec. 28, 2017

(30) Foreign Application Priority Data

Jun. 23, 2016 (FR) ..... 16 55892

(51) Int. Cl.

| | |
|---|---|
| ***F21V 15/00*** | (2015.01) |
| ***F21V 15/01*** | (2006.01) |
| ***F21S 41/29*** | (2018.01) |
| ***F21S 41/24*** | (2018.01) |
| ***F21L 4/00*** | (2006.01) |
| *F21S 41/20* | (2018.01) |
| *F21S 8/10* | (2006.01) |
| *F21W 131/10* | (2006.01) |

(52) U.S. Cl.

CPC ..... *F21V 15/01* (2013.01); *F21L 4/00* (2013.01); *F21S 41/24* (2018.01); *F21S 41/29* (2018.01); *F21S 48/1208* (2013.01); *F21S 48/1241* (2013.01); *F21S 41/20* (2018.01); *F21S 48/12* (2013.01); *F21W 2131/10* (2013.01)

(58) Field of Classification Search

CPC . F21V 15/01; F21S 41/24; F21S 41/29; F21S 48/1208; F21S 48/1241; F21S 41/20; F21S 48/12; F21L 4/00; F21W 2131/10

See application file for complete search history.

(56) References Cited

U.S. PATENT DOCUMENTS

2012/0008309 A1* 1/2012 Hale ..... F21L 4/06 362/105

2013/0308305 A1 11/2013 Arndt et al.

FOREIGN PATENT DOCUMENTS

FR 2986304 A1 8/2013

* cited by examiner

*Primary Examiner* — Donald Raleigh

(74) *Attorney, Agent, or Firm* — Oliff PLC

(57) ABSTRACT

The invention relates to a light diffuser casing comprising an enclosure defining a cavity and provided with a closable opening configured to enable a headlamp to be inserted inside the casing. A light diffuser is arranged in the casing to receive a light beam coming from the headlamp and to make said beam diffuse on the enclosure. The light diffuser is made from a translucent or transparent material so that said beam passes through it, and the enclosure is made from a translucent material. The invention also relates to a method for using the casing.

14 Claims, 1 Drawing Sheet

LIGHT DIFFUSER CASING

FIELD OF THE INVENTION

The invention relates to a light diffuser casing, and to a method for using one such casing.

STATE OF THE ART

It is commonplace to possess a headlamp for use when mountaineering. The user keeps his lamp close at hand and can place it on his head as soon as he needs to in order to light his direct environment during his climbing activity.

During rest periods, for example when bivouacking, the use of a headlamp is less practical as the directional beam of the lamp does not enable a large space to be lit. Focusing of the beam is also a nuisance when a user is looking at someone as the person is dazzled. To avoid these inconveniences, the headlamp is often hung up or placed on the ground so as not to dazzle anybody, which is not convenient either as the lighted area is not the one the users need to be able to see.

To remedy this problem, portable light diffusers exist which can be used in association with a headlamp.

The Mammut company has marketed a flexible and translucent bag able to be used both as storage cover and light diffuser. The large volume of the bag makes it possible to store not only the lamp but also other accessories useful for mountaineering activities. To be able to be used as light diffuser, the bag first of all has to be emptied and closed. The front strap of the lamp has to be removed, and the lamp has to be fixed to an external strap of the bag so that the lighting system emits light in the direction of the inside of the bag. The fact that the bag is translucent enables a diffuse light to be obtained.

The drawback of such a device is its complexity of installation, as the front strap has to be removed before it is able to be fitted on the bag. It is further necessary for the bag to be empty, which may prove inconvenient when it is used to stow a number of different items, all the more so if the weather conditions are not favourable to unpacking the bag.

Another light diffuser is marketed by the Mammut company. It comes in the form of a rigid and translucent casing comprising a removable cover at one end, in place of which a headlamp can be fitted. The casing comprises a light reflector positioned inside the casing at a second end opposite the first end so as to be facing the light beam emitted by the lamp. The role of the light reflector is to reflect the light emitted by the lamp in the direction of the side walls of the casing so that the casing emits a diffuse light.

The size and weight of the light diffuser may be a nuisance for the user who has to carry his equipment during his mountaineering activities. Another drawback is that the diffuser can only be used in association with a specific headlamp. The rigidity of the material forming the casing does not in fact enable a lamp larger than the cover of the casing to be fixed. If the lamp is smaller than the cover of the casing, it doesn't hold very firmly and the light beam is not directed in the centre of the reflector, which greatly reduces the performances of the light diffuser.

OBJECT OF THE INVENTION

One object of the invention consists in providing a multifunction casing that is light and compact, which acts both as light diffuser and as protective casing, so as to be useful in all circumstances.

For this purpose, the casing comprises:

an enclosure defining a cavity and provided with a closable opening configured to allow insertion of a headlamp inside the casing, a light diffuser arranged to:

receive a light beam coming from the headlamp and to make said beam diffuse on the enclosure, the light diffuser being made from a translucent or transparent material so that said beam passes through the light diffuser, the enclosure being made from a translucent material.

According to an advantageous embodiment, the light diffuser can be made from a material chosen from the family of thermoplastic polyurethanes.

The casing can further comprise a separator separating the cavity into a first housing configured to house the headlamp and a second housing distinct from the first housing, the separator being made from a translucent or transparent material. The separator can be made from a material chosen from the family of thermoplastic polyurethanes.

In preferred manner, the light diffuser and the separator can be one and the same part.

Furthermore, the separator can be concave so as to form a concave wall in the first housing. It can also be configured to block movement of the headlamp in the first housing.

According to an advantageous embodiment, the enclosure of the first housing can be made from an elastically deformable material so as to be able to switch the lamp placed in the casing on and off. More precisely, the enclosure of the first housing can be made from a material chosen from the family of thermoplastic polyurethanes.

The enclosure of the second housing can furthermore be made from a material chosen from the family of thermoplastic polyurethanes.

The invention also relates to a method for using a diffuser casing provided with the above-mentioned features, and comprising the following steps:

providing a headlamp, positioning the headlamp in the cavity of the protective casing so as to direct the beam towards the enclosure through the light diffuser, lighting the headlamp by pressing on an elastically deformable area of the enclosure.

BRIEF DESCRIPTION OF THE DRAWINGS

Other advantages and features will become more clearly apparent from the following description of particular embodiments of the invention given for non-restrictive example purposes only and represented in the appended drawings, in which.

DETAILED DESCRIPTION

Figure 1:
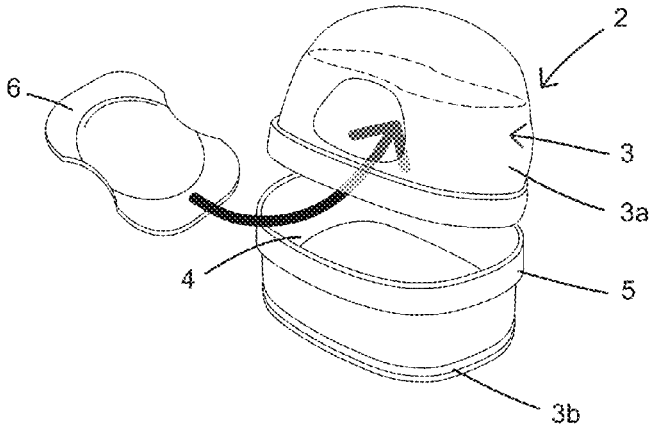
FIG. 1 represents an embodiment of a light diffuser casing in schematic manner.

To house a headlamp 1, a casing 2 advantageously comprises an enclosure 3 defining a cavity 4. The enclosure 3 is provided with a closable opening 5 which enables insertion of the headlamp 1 inside the casing 2. The opening 5 can for example be closed by means of a zip closure. The edges of the opening 5 can be magnetised or provided with a sliding closing means, for example a zip (Eclair®), in order to be able to open and close the protective casing 2 easily.

The opening 5 can be placed on the lateral part 3*a* of the enclosure 3, as represented in the figures. When the casing 2 is configured to be placed on a flat surface, the enclosure 3 can comprise a bottom 3*b* acting as a base. The opening 5 can then consist of separating means between the bottom 3*b* and the lateral part 3*a*. It can for example be imagined that the bottom 3*b* is screwed onto the lateral part 3*a* as a cover would be.

Figure 2:
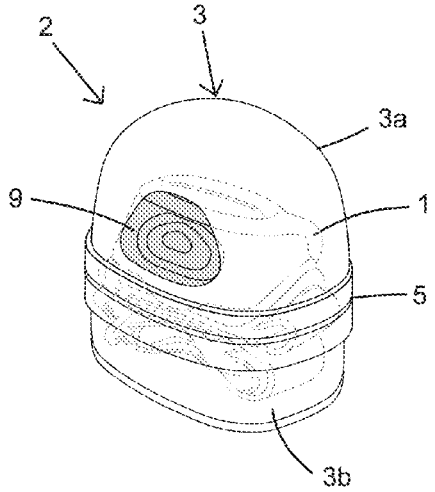
FIG. 2 illustrates the manner in which a headlamp can be stowed in the casing of FIG. 1.
Figure 3:
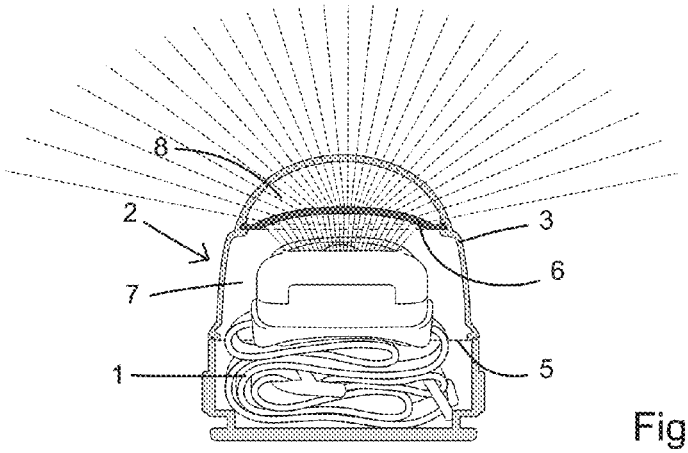
FIG. 3 represents a possible use of the casing according to the embodiment illustrated in FIGS. 1 and 2.

According to an advantageous embodiment, the casing 2 can be used not only to protect the headlamp 1 but also as light diffuser (cf. FIGS. 2 and 3).

For the light emitted by the headlamp 1 to be diffused in the largest number of possible directions, the protective casing 2 advantageously comprises a light diffuser. The latter is arranged both to receive a light beam emitted by the lamp 1 and also to make the beam diffuse on the enclosure 3 of the casing 2.

The light diffuser can for example be placed in contact or placed sufficiently close to the headlamp 1 to prevent the latter from moving. This also enables diffusion of the light to the enclosure 3 to be optimised. For this, notches or salient portions can be provided inside the enclosure to secure the light diffuser in the casing 2. The light diffuser can also be secured to the enclosure 3 by means of a set of elastic bands connecting the ends of the light diffuser to the inner wall of the enclosure 3.

To enable light transmission, the light diffuser is made from a transparent or translucent material. The material can be chosen from the family of thermoplastic polyurethanes.

The casing 2 can also comprise a separator 6 advantageously fitted in removable manner in the cavity. The separator 6 can rest on salient portions of the enclosure 3 or be inserted in notches provided on the inner wall of the enclosure 3. The first solution can preferably be chosen when the material of the separator 6 is rigid, whereas the second solution is preferred when the separator 6 can undergo an elastic deformation without becoming fragile.

The separator 6 is arranged in such a way that the cavity is separated into a first housing 7 the dimensions of which enable the headlamp 1 to be housed, and a second housing 8 configured to allow transmission of the light emitted by the headlamp 1 to the outside of the casing 2 through the second housing 8.

The position of the separator 6 in the cavity 4 is adjusted so that the separator 6 prevents movement of the headlamp 1 in the first housing 7. In this way, when the headlamp 1 is correctly positioned in the first housing, the performances of the protective casing 2 as light diffuser are optimal.

According to a particular embodiment (not shown), a part of the enclosure 3 can be imagined to have sections of identical shapes and dimensions, which enables the separator 6 to be placed in various positions to enable headlamps 1 of different sizes to be accommodated. This makes the casing particularly versatile.

It is also possible for the enclosure of the first housing 7 to be elastically deformable to allow insertion of different shapes of headlamps 1.

The separator 6 can further have a shape matching the shape of the headlamp 1 in order not to damage the latter. For example, when the headlamp is concave, it may be advantageous for the wall of the separator 6 closing the first housing to be concave. This limits the risk of scratching on the optic casing of the lamp 1, which is directed towards the separator 6.

To allow transmission of the light emitted by the headlamp 1 in the direction of the second housing 8, the separator 6 is advantageously made from a translucent or transparent material. The material is chosen from the family of thermoplastic polyurethanes.

As the separator 6 divides the cavity 4 into two housings, the light diffuser can be arranged both to receive a light beam emitted by the lamp 1 coming from the first housing 7 and to make the beam diffuse on the enclosure of the second housing 8. The light diffuser and the separator 6 can for example be positioned in parallel manner and advantageously be against one another to limit as far as possible the decrease of the light intensity when the beam passes from the first housing 7 to the second housing 8. Notches or salient portions are then provided inside the enclosure to secure the light diffuser in the casing 2.

In order to gain in compactness, the separator 6 and the light diffuser can be formed from a single part made from two different materials. In this case, the separator 6 advantageously corresponds to the wall situated on the side where the first housing 7 is situated, whereas the light diffuser corresponds to the wall of the second housing 8.

The separator 6 and the light diffuser can also be one and the same, i.e. made from a single part formed from a single material. The material is advantageously translucent and diffuses light preferably in the whole of the second housing 8.

For the casing to act as light diffuser, the enclosure of the second housing 8 is also made from a material which diffuses light. The material can be chosen from the family of thermoplastic polyurethanes. The material can advantageously be UV-treated.

In general manner, the enclosure comprises an elastically deformable area 9 near to the place where the lamp 1 is placed in the cavity 4 so that the lamp can be switched on and off. When the casing comprises a separator 6, the elastically deformable area 9 is placed on the enclosure of the first housing 7. The area 9 can for example take the form of a push-button. It is then necessary to make sure that the push-button of the headlamp 1 is placed facing the area 9.

The whole of the enclosure of the first housing 7 can advantageously be made from an elastically deformable material for the headlamp 1 to be placed in any manner in the first housing provided that the lighting area is directed towards the separator 6, and therefore towards the second housing 8. The enclosure of the first housing 7 can be made from a material chosen from the family of thermoplastic polyurethanes. As for the second housing 8, the material of the first housing 7 can be UV-treated so that it degrades less quickly in case of prolonged exposure to ultra-violet rays.

According to a particular embodiment of the casing 2, it can be envisaged to use a single material to form the enclosure 3 and the separator 6 which is the same part as the light diffuser. Using a single material simplifies the manufacturing process of the casing 2, which can for example be produced by moulding from a casting. The material must be translucent, light-diffusing and elastically deformable.

The casing 2 can advantageously be provided with a strap (not shown) fixed for example onto the outer wall of the bottom 3*b*. The strap can also be situated on the lateral part 3*a* of the enclosure 3, but this configuration is not optimal as it prevents diffusion of light in the area where it is attached. Whatever the position of the strap on the casing 2, it can easily facilitate securing of the casing 2 to a bag. The casing 2 can for example be secured to a ventral securing strap of a rucksack.

The casing 2 can also comprise a hook (not shown) on the outer surface of the enclosure 3 so as to be able to suspend the latter. In this way, during night-time rest periods, for example when bivouacking or eating, the casing 2 can act as a lantern and illuminate the environment with a diffuse light. This is particularly pleasant when several people are sharing this rest time, for if the users wear their headlamps on their heads, they dazzle each another when they look at each other.

To use the protective casing 2 as light diffuser, the headlamp 1 first has to be inserted in the cavity 4 and be positioned in such a way that it emits light to the enclosure 3. The light diffuser is then positioned inside the cavity 4 and secured against the headlamp 1. The casing 2 can then be closed and the headlamp 1 can be switched on by pressing on the elastically deformable area 9. The casing 2 then simply has to be placed or suspended in the space it has to light. When the user no longer needs to be illuminated, the headlamp 1 can be switched off by pressing again on the area 9.

The separator 6 can be added in order to improve securing of the headlamp 1 in a given area. In this case the separator 6 and the light diffuser can be positioned inside the cavity securing them in the notches or on the salient portions provided for this purpose.

The use of a protective casing 2 such as the one which has just been described is particularly advantageous, as the casing 2 fulfils several roles at the same time. Not only does the casing 2 protect the lamp, but it can also act as backup lamp when the user needs a diffuse light, for example when bivouacking. The user no longer needs to multiply the headlamp accessories, which represents a gain both in weight and in volume.

The invention claimed is:

1. Light diffuser casing comprising:

an enclosure defining a cavity and provided with a closable opening configured to allow a headlamp to be inserted inside the light diffuser casing, a light diffuser arranged, to receive a light beam coming from the headlamp and to make said beam diffuse on the enclosure, wherein the light diffuser is made from a translucent or transparent material so that said beam passes through the light diffuser, the enclosure being made from a translucent material.

2. Casing according to claim 1, wherein the light diffuser is made from a material chosen from thermoplastic polyurethane compounds.

3. Casing according to claim 1, comprising a separator separating the cavity into a first housing configured to house the headlamp, and a second housing distinct from the first housing, the separator being made from a translucent or transparent material.

4. Casing according to claim 3, wherein the separator is made from a material chosen from thermoplastic polyurethane compounds.

5. Casing according to claim 3, wherein the light diffuser and the separator are one and the same part.

6. Casing according to claim 4, wherein the light diffuser and the separator are one and the same part.

7. Casing according to claim 3, wherein the separator comprises a concave wall in the first housing.

8. Casing according to claim 6, wherein the separator comprises a concave wall in the first housing.

9. Casing according to claim 3, wherein the separator is configured to block movement of the headlamp in the first housing.

10. Casing according to claim 6, wherein the separator is configured to block movement of the headlamp in the first housing.

11. Casing according to claim 1, wherein the enclosure of the first housing is made from an elastically deformable material so as to enable the headlamp placed in the casing to be switched on and off.

12. Casing according to claim 11, wherein the enclosure of the first housing is made from a material chosen from thermoplastic polyurethane compounds.

13. Casing according to claim 1, wherein the enclosure of the second housing is made from a material chosen from thermoplastic polyurethane compounds.

14. Method for using a light diffuser casing, comprising the following steps:

providing a headlamp and a light diffuser casing, the light diffuser casing comprising:

an enclosure made from a translucent material and configured to define a cavity and provided with a closable opening so as to open or close the cavity, a light diffuser arranged to receive a light beam coming from the headlamp and to make said beam diffuse on the enclosure, inserting the headlamp in the cavity of the light diffuser casing so as to direct the beam towards the enclosure through the light diffuser, lighting the headlamp by pressing on an elastically deformable area of the enclosure;

wherein the light diffuser is made from a translucent or transparent material so that said light beam passes through the light diffuser.

* * * * *